US005400706A

United States Patent [19]

Tipton et al.

[11] Patent Number: 5,400,706

[45] Date of Patent: Mar. 28, 1995

[54] MACHINE FOR STRAPPING LOAD-CARRYING SKID

[75] Inventors: Allison D. Tipton, Bloomingdale; Margaret Fialko, Glenview; Brian H. Hamlin, Mundelein; Ray A. Yeackley, Wheeling, all of Ill.

[73] Assignee: Signode Corporation, Glenview, Ill.

[21] Appl. No.: 198,342

[22] Filed: Feb. 18, 1994

Related U.S. Application Data

[63] Continuation-in-part of Ser. No. 123,992, Sep. 21, 1993, Pat. No. 5,355,786.

[51] Int. Cl.[6] ..... B65B 13/06

[52] U.S. Cl. ..... 100/4; 53/52; 53/589; 100/7; 100/14; 100/25

[58] Field of Search ..... 100/4, 7, 14, 25, 26; 53/52, 391, 504, 589

[56] References Cited

U.S. PATENT DOCUMENTS

| | | | |
|---|---|---|---|
| 3,019,577 | 2/1962 | Slamar et al. | 53/589 |
| 3,057,289 | 10/1962 | Lüthi | 100/14 |
| 3,150,585 | 9/1964 | Sterner | 100/25 |
| 3,182,586 | 5/1965 | Armington et al. | 100/25 |
| 3,213,781 | 10/1965 | Collins et al. | 100/26 |
| 3,279,354 | 10/1966 | Dickens et al. | 100/26 |
| 3,294,012 | 12/1966 | Kobiella | 100/26 |
| 3,376,807 | 4/1968 | Sterner | 100/26 |
| 3,566,780 | 3/1971 | Chisek et al. | 100/26 |
| 3,949,662 | 4/1976 | Woomer | 100/26 |
| 4,228,733 | 10/1980 | Davis et al. | 100/26 |
| 4,254,703 | 3/1981 | Fulton et al. | 100/26 |

*Primary Examiner*—Stephen F. Gerrity
*Attorney, Agent, or Firm*—T. W. Buckman; D. J. Breh

[57] ABSTRACT

In a machine for strapping a skid and a supported load by the use of a strap passing through aligned openings in the skid runners, a conveyor is provided for conveying the skid through a feeding zone. A turntable including powered rollers is provided for receiving the skid and the supported load from the conveyor, for positioning same within a strapping zone, and for rotating same within. A vertical scanner comprising a vertical array of photoelectric transmitters spaced from one another, on one side of the feeding zone, and a vertical array of photoelectric receivers spaced from one another, on the other side of the feeding zone, is provided for scanning the skid being conveyed. Two horizontal scanners, each comprising a single photoelectric transmitter and a single photoelectric receiver on each side of the strapping zone, are provided for scanning the skid being conveyed after it has been scanned by the vertical arrays. Two strap guides are provided, each extending transversely and each being movable along a transverse between an extended position, in which it extends across the strapping zone, and a withdrawn position, in which it does not interfere with the skid being conveyed. The horizontal scanners and the strap guides are adjustable vertically and conjointly in response to the vertical scanners. The horizontal scanners are movable into and from operative positions in the paths of the strap guides.

16 Claims, 10 Drawing Sheets

5
5
10
12
14
16
18
20
22
24
26
30
40
50
52
54
60
62
70
72
74
80
90
96
98
100
102
104
110

MACHINE FOR STRAPPING LOAD-CARRYING SKID

CROSS-REFERENCE TO RELATED APPLICATION

This application is a continuation-in-part of the Tipton et al. U.S. patent application Ser. No. 08/123,992 for IMPROVED STRAP GUIDE FOR GUIDING STRAP THROUGH ALIGNED OPENINGS IN PALLET STRINGERS, which was filed Sep. 21, 1993 (U.S. Pat. No. 5,355,786), which is assigned commonly herewith, and the disclosure of which is incorporated herein by reference.

TECHNICAL FIELD OF THE INVENTION

This invention pertains to an improved machine for strapping a skid having parallel runners including two outer runners, together with a load carried on the skid, by means of a strap passing through aligned openings in the respective runners. The strapping machine employs a strap guide or a pair of strap guides of an improved type disclosed in the copending application referenced above.

BACKGROUND OF THE INVENTION

In certain industries including the fine paper industry, shipping pallets or skids having parallel stringers or runners with very small notches or other openings (e.g. about 2.5 inches in width and about 1.5 inches in height) are employed. Such notches or other openings may be widely spaced (e.g. by several feet) in the stringers or runners of such a pallet or skid.

Herein, the terms "pallet" and "skid" are used interchangeably to refer to a load-supporting platform with parallel runners including two outer runners and with an upper decking structure, whether or not the load-supporting platform also has a lower decking structure. Herein, moreover, the terms "stringer" and "runner" are used interchangeably.

In a machine for strapping such a skid, together with a load supported by the skid, steel or polymeric straps are fed around the skid and the supported load, tensioned, and sealed. Such straps may be thus applied in orthogonal planes, respectively as girth straps and as cross straps. It is known for such a machine to comprise a feeding conveyor for feeding a skid and the supported load through a feeding zone, into a strapping zone, in which the straps are applied.

In such a machine, it is known to use one or more strap guides of a type comprising an elongate channel, which is supported from a proximal end as a cantilever. As directed via an automated mechanism or manually through aligned openings or notches in the runners of the skid, each strap guide guides a steel or polymeric strap through such openings or openings when the strap is fed and releases the strap when the strap is tensioned.

An improved strap guide of the type noted above is disclosed in the copending Tipton et al. application referenced above. The improved strap guide has a channel having a distal end, at which the strap guide enters aligned openings in the skid runners, and includes means for counteracting tendencies of its distal end to be downwardly deflected by gravity.

Before the improved strap guide noted above became available, it was not feasible to provide an automatic machine for strapping a skid and a supported load, if the skid runners had very small openings (e.g. about 2.5 inches in width and about 1.5 inches in height) to admit a strap guide.

SUMMARY OF THE INVENTION

Generally, this invention provides an improved machine for strapping a skid having parallel runners including two outer runners and having aligned openings in the respective runners, together with a load supported by the skid. The improved machine comprises or is operable with a conveyor for conveying the skid and the supported load longitudinally through a feeding zone defined by the conveyor. The improved machine comprises means including a turntable with powered rollers for receiving the skid and the supported load from the conveyor, for positioning the skid and the supported load in a girth-strapping position within a strapping zone defined by the turntable, by means of the powered rollers of the turntable, and for rotating the skid and the supported load to a cross-strapping position within the strapping zone, by means of the turntable.

The improved machine further comprises means including a strap guide for guiding a strap through aligned openings in the respective runners, when the skid and the supported load are positioned in the girth-strapping position. The strap guide extends transversely and is movable along a path of transverse movement between an extended position, in which the strap guide extends across-the strapping zone, and a withdrawn position, in which the strap guide is withdrawn so as not to interfere with the skid or the supported load.

In accordance with the Tipton et al. application referenced above, the strap guide has a channel having a distal end, at which the strap guide enters aligned openings in the skid runners, and includes means for counteracting tendencies of the distal end to be downwardly deflected by gravity, so as to adapt the strap guide to extend through aligned openings in the respective runners when the skid and the supported load are positioned in the girth-strapping position and to extend between the outer runners when the skid and the supported load are positioned in the cross-strapping position.

The improved machine further includes means including a strapping head for passing a strap through the strap guide in the extended position, so as to pass the strap through aligned openings in the respective runners when the skid and the supported load are positioned in the girth-strapping position within the strapping zone and so as to pass the strap between the outer runners when the skid and the supported load are positioned in the cross-strapping position. The strapping head is operable to apply the strap around the supported load.

Preferably, the improved machine further comprises means for scanning the skid and the supported load as the skid and the supported load are conveyed through the feeding zone. Preferably, moreover, the conveying means and the positioning and rotating means are operable in response to the scanning means for positioning the skid and the supported load in the girth-strapping position.

The scanning means may include vertical scanning means, which include means for transmitting a vertical array of photoelectric beams transversely across the feeding zone, at elevations where at least some of the photoelectric beams of the vertical array can intersect one of the outer runners of such a skid being conveyed through the feeding zone, and which include means for receiving whichever of the photoelectric beams of the vertical array are not interrupted, as by one of the outer runners of such a skid being conveyed through the feeding zone. Preferably, the transmitting means of the vertical scanning means include a vertical array of photoelectric transmitters spaced from one another, on one side of the feeding zone, and the receiving means thereof include a vertical array of photoelectric receivers spaced from one another, on the other side of the feeding zone.

Moreover, the scanning means may include horizontal scanning means, which include means for transmitting a horizontal array of photoelectric beams transversely across the strapping zone, at an elevation where the photoelectric beams of the horizontal array can intersect one of the outer runners of such a skid in the strapping zone, and which include means for receiving whichever of the photoelectric beams of the horizontal array are not interrupted, as by one of the outer runners of such a skid in the strapping zone. Preferably, the transmitting means of the horizontal scanning means include two photoelectric transmitters, one on each side of the strapping zone, and the receiving means of the horizontal scanning means include two photoelectric receivers, one on each side of the strapping zone. Preferably, moreover, each photoelectric transmitter of the horizontal scanning means is arranged to transmit one of the photoelectric beams toward the photoelectric receiver of the horizontal scanning means on the other side of the strapping zone.

In a preferred arrangement, the scanning means include two horizontal scanning means, each as described above, and the improved machine comprises two strap guides, each as described above, and two strapping heads, each as described above. Each of the strap guides is associated with a respective one of horizontal scanning means. Each of the strapping heads is operable similarly so as to coact with a respective one of the strap guides. The strapping heads are operable selectively to apply no strap, one strap, two straps, or multiple straps when the skid and the supported load are in either of the girth-strapping and cross-strapping positions.

Preferably, the strapping heads are mounted on a platen extending between two upright columns and is movable vertically along the upright columns. Preferably, moreover, the strapping heads are interchangeable with other strapping heads so as to enable the strapping machine to be selectively useful with steel strapping or with polymeric strapping.

Moreover, in the preferred arrangement, the improved machine comprises means for positioning the strap guides and the horizontal scanning means conjointly and vertically in response to whichever of the photoelectric receivers of the vertical scanning means receive such photoelectric beams as such a skid and such a supported load are conveyed past the vertical arrays of photoelectric transmitters and photoelectric receivers.

These and other objects, features, and advantages of this invention are evident from the following description of a preferred embodiment of this invention with reference to the accompanying drawings.

DETAILED DESCRIPTION OF PREFERRED EMBODIMENT

Figures 1, 2:
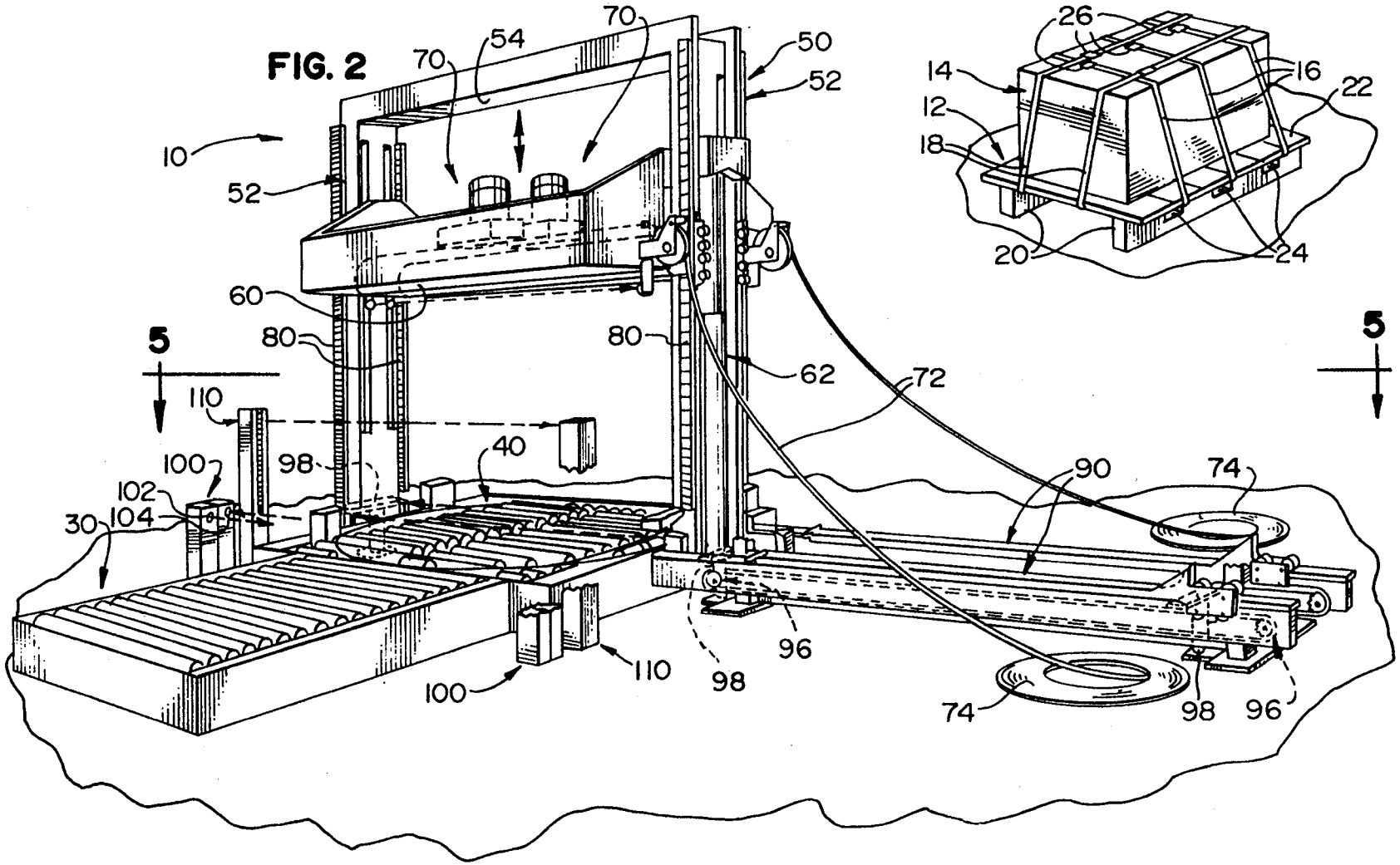
FIG. 1 is a perspective view of a skid having two parallel, outer runners and a supported load, as strapped with three girth straps and with two cross straps.
FIG. 2 is a partly fragmentary, partly schematic, perspective view of a machine for strapping such a skid, together with such a supported load, by means of plural steel or polymeric straps.

As shown in FIG. 2, a strapping machine 10 constitutes a preferred embodiment of this invention. The strapping machine 10 is used to strap a skid 12, together with a load 14 supported by the skid or pallet 12, with steel or polymeric straps in orthogonal planes. Preferably, as shown in FIG. 1, the skid 12 and the supported load 14 are strapped with three girth straps 16 and with two cross straps 18. Each of these straps 16, 18, is sealed with a steel seal 26. The strapping machine 10 may be also used to apply steel or polymeric straps in other strapping patterns, which may include zero, one, two, three, or multiple girth straps and which may include zero, one, or two cross straps.

As shown in FIG. 1, in which the supported load 14 is shown as comprised of stacked paper sheets, the skid 12 is made of lumber pieces, namely two longitudinally extending outer runners 20 and plural transversely extending upper decking boards 22. The upper decking boards 22, which abut one another edgewise, are fastened by nails (not shown) to the runners 20. Each outer runner 20 has one, two, or multiple strap-accommodating openings 24, three being shown, where such outer runner 20 meets the upper decking boards 22. Each opening 24 in each outer runner 20 is aligned with one of the openings 24 in the other outer runner 20.

The skid 12 may also include lower decking boards (not shown) abutting one another edgewise and fastened similarly to the runners 20. The skid 12 may also include a longitudinally extending middle runner (not shown) between the outer runners 20. If such a middle runner is included, it has strap-accommodating openings similar to and aligned with the strap-accommodating openings 24 in each outer runner 20.

Figure 5:
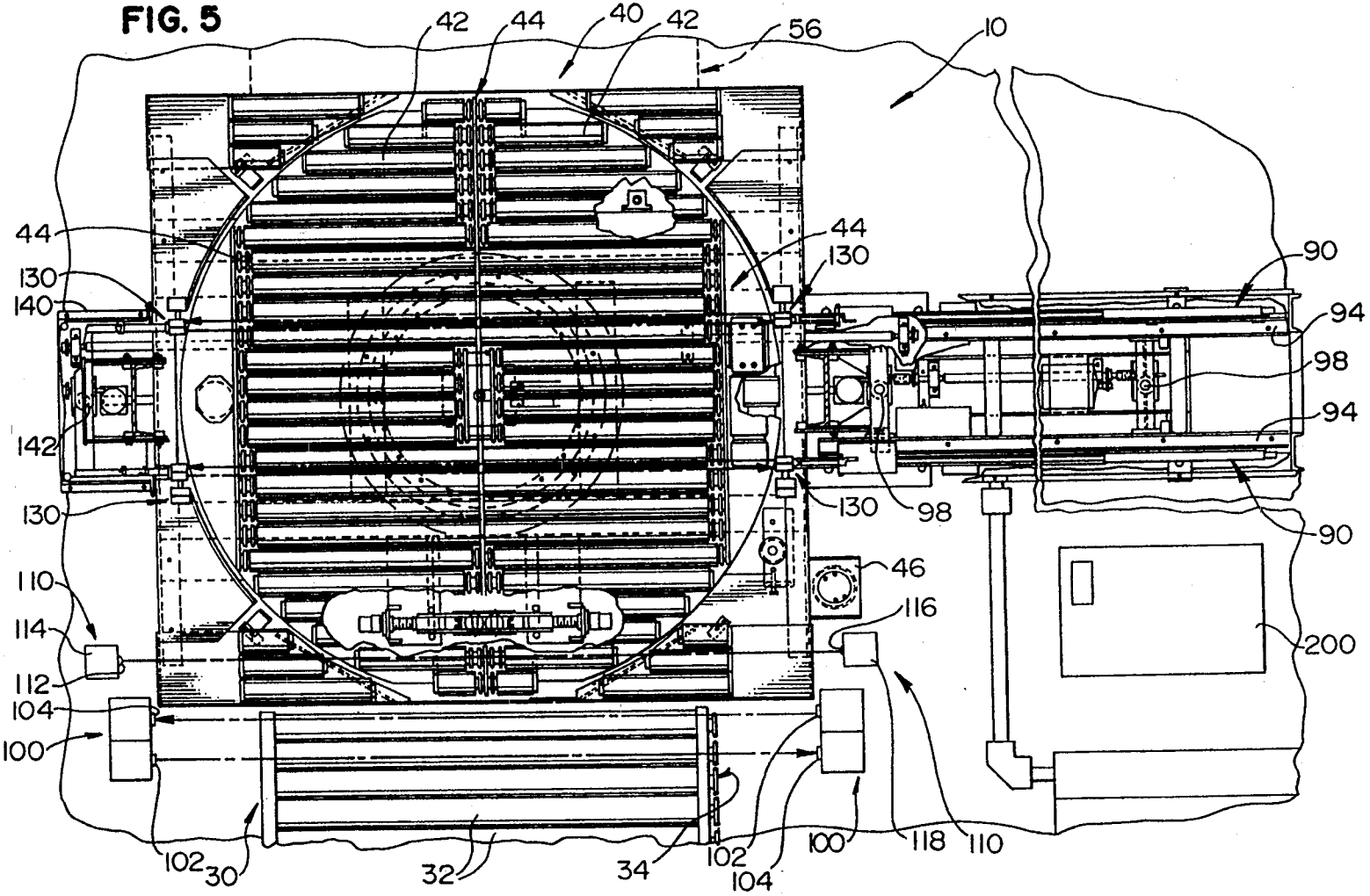
FIG. 5 is a sectional view taken along line 5—5 of FIG. 2, in a direction indicated by arrows.
Figure 6:
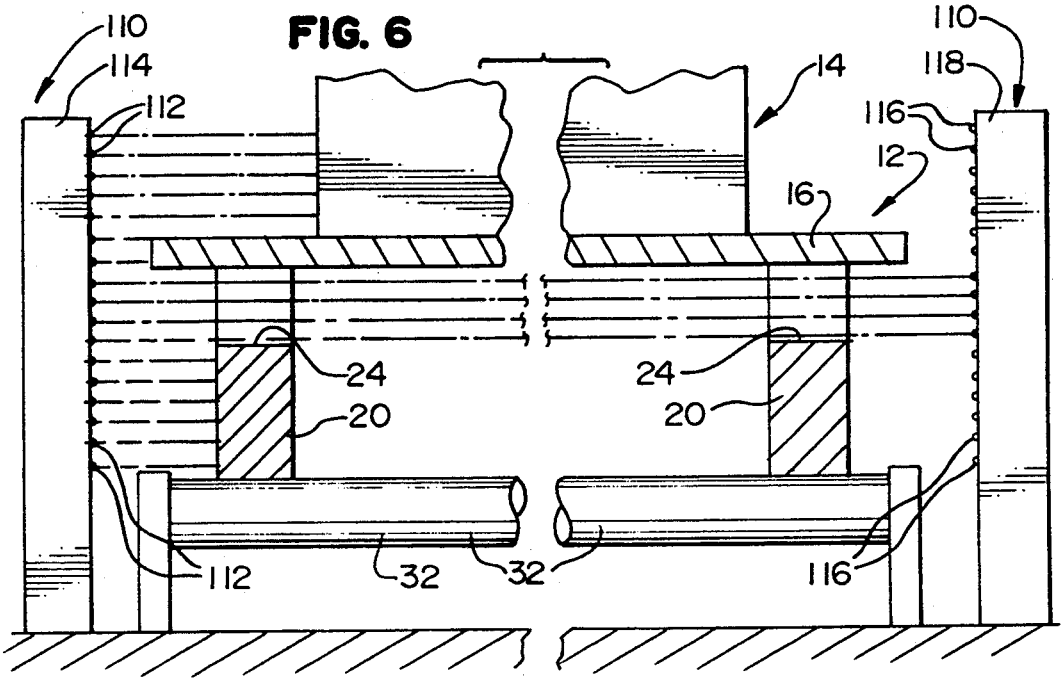
FIG. 6 is a schematic, elevational view, looking along the feeding conveyor and showing such a skid and such a supported load as the skid and the load are scanned by the vertical scanning means, when aligned openings in the skid runners pass the vertical scanning means.

As shown in FIGS. 2 and 5, the strapping machine 10 comprises a feeding conveyor 30, which defines a feeding zone. The feeding conveyor 30 comprises a longitudinal array of rollers 32 arranged to be conjointly driven by a motor (not shown) via a chain and sprocket drive 34.

As shown in FIGS. 2 and 5, the feeding conveyor 30 is arranged to convey the skid 12 and the supported load 14 longitudinally through the feeding zone, into a strapping zone. In each such zone, the skid 12 and the supported load 14 are scanned by various photoelectric scanners to be later described.

Figure 12:
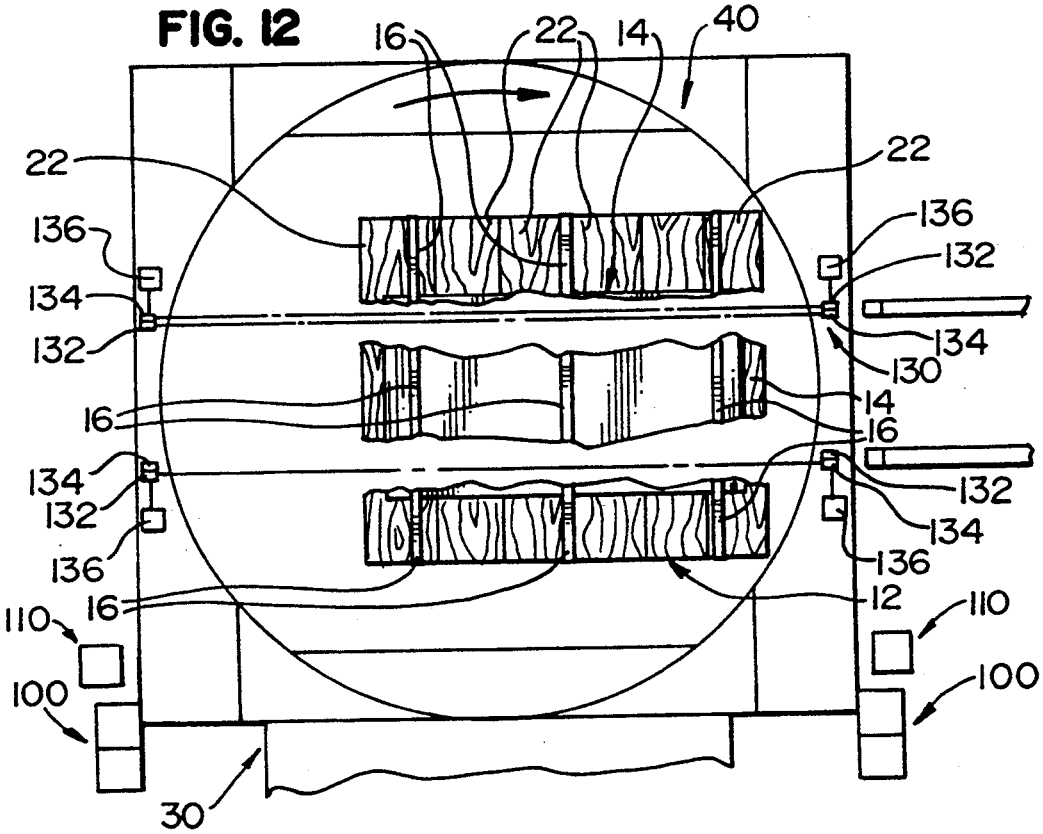
FIGS. 12 and 13 are similar, schematic views, showing the skid and the supported load as having being rotated by one quarter-turn in the strapping zone, respectively as the skid is scanned by both sets of horizontal scanning means in operative positions and as the strap guides are advanced with the strap guides in inoperative positions.
Figure 13:
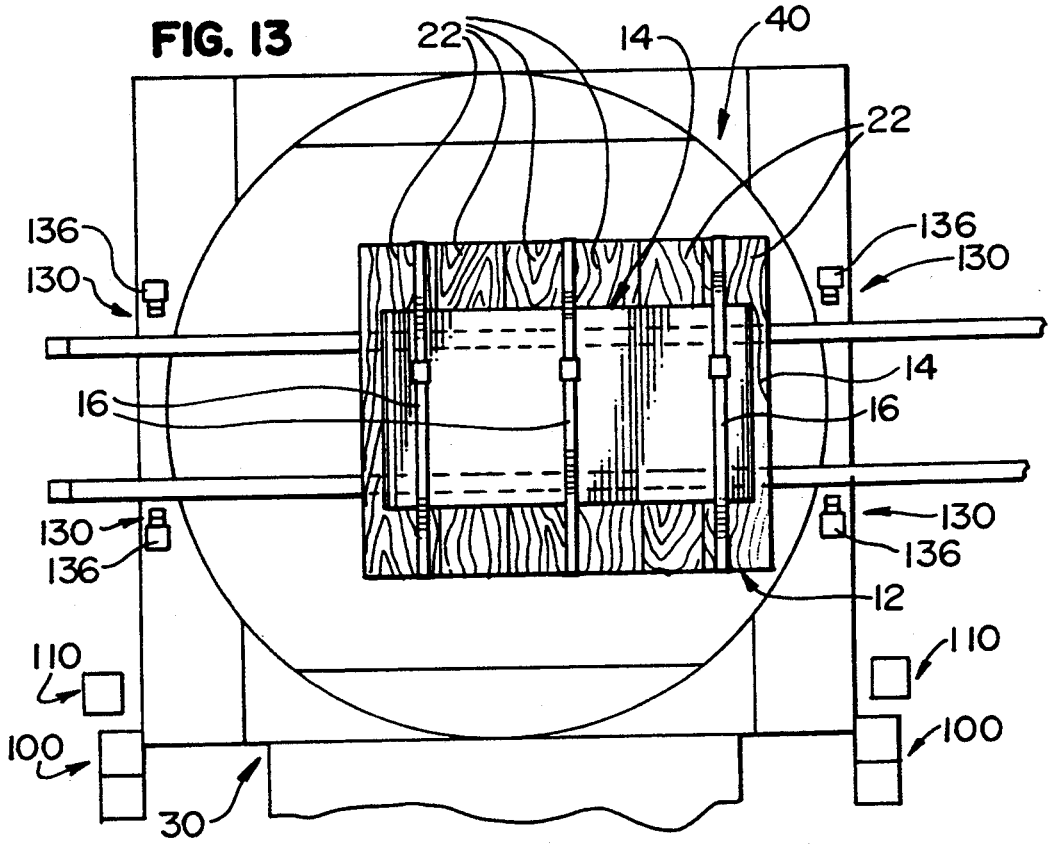

Moreover, the strapping machine 10 comprises a turntable 40, which defines the strapping zone. The turntable 40 comprises two sets of parallel rollers 42, which are arranged to be conjointly driven by a motor (not shown) via multiple chain and sprocket drives 44. As shown in FIG. 5, the turntable 40 is arranged to be rotatably driven about a vertical axis, by a motor 46 via a chain and sprocket drive 48. The turntable 40 has a normal position, in which it is shown in FIGS. 2 and 5 and other views and in which its rollers 42 are parallel with the rollers 32 of the feeding conveyor 30, and a rotated position, in which it is shown in FIGS. 12 and 13 and other views and in which it has been rotated by one quarter-turn from its normal position.

The turntable 40 is arranged successively to receive the skid 12 and the supported load 14 from the feeding conveyor 30, to convey the skid 12 and the supported load 14 within the strapping zone to a centered position, in which two girth straps 16 are applied, to convey the skid 12 and the supported load 14 within the strapping zone to a forward position, in which another girth strap 16 is applied, to rotate the skid 12 and the supported load 14 within the strapping zone, after all of the girth straps 16 have been applied, by one quarter-turn from the forward position to a rotated position, in which one or two cross straps 18 are applied, to rotate the skid 12 and the supported load 14 within the strapping zone, after the cross straps 18 have been applied, from the rotated position to the forward position, and to convey the skid 12 and the supported load 14, as strapped with the girth straps 16 and with the cross straps 18, from the turntable 40 onto a takeaway conveyor 56, which is illustrated fragmentarily in dashed lines in FIG. 5.

Figure 3:
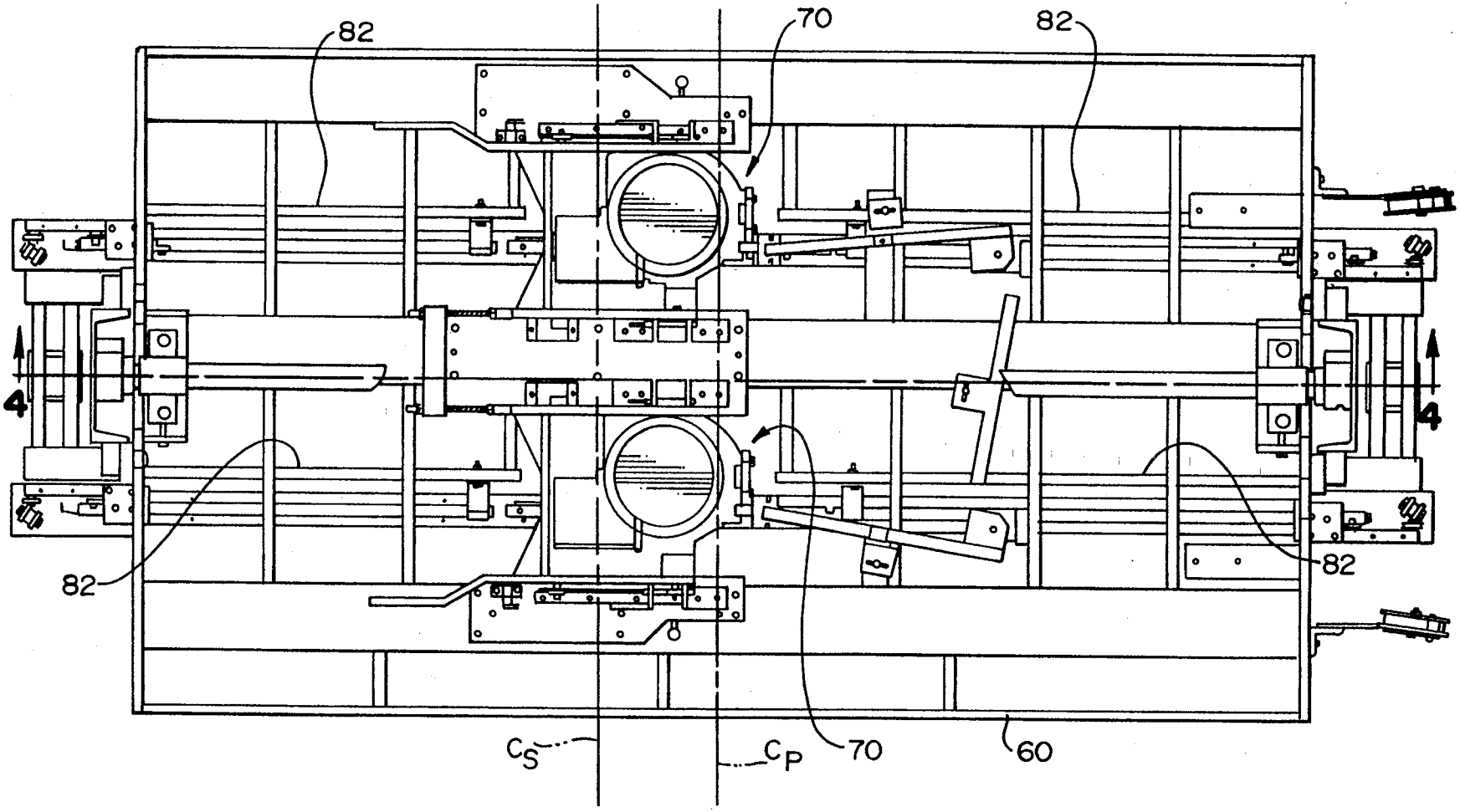
FIG. 3 is a fragmentary, plan view of a platen and two strapping heads, as employed in the strapping machine. The centerline of the strapping machine and the centerline of the seals applied by the strapping heads are indicated.
Figure 4:
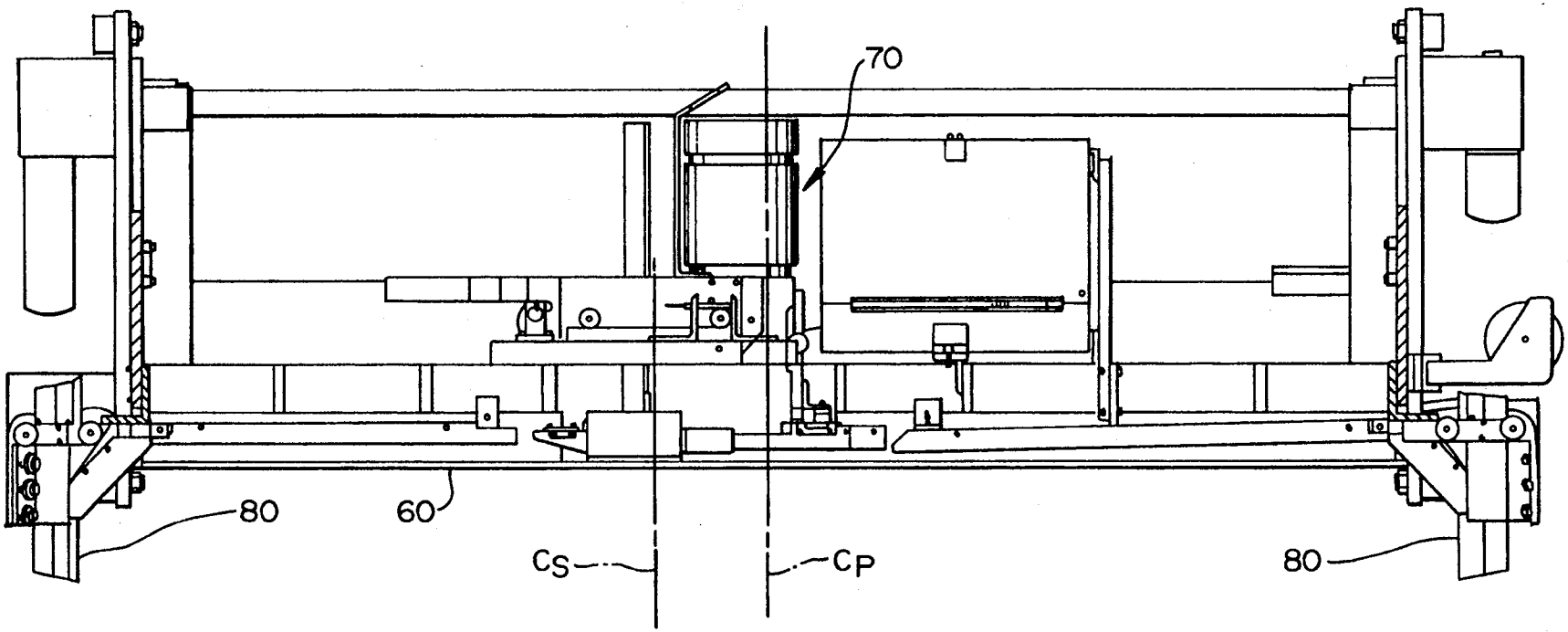
FIG. 4 is a sectional view taken along line 4—4 of FIG. 3, in a direction indicated by arrows. The centerline of the strapping machine and the centerline of the seals applied by the strapping heads again are indicated.

As shown in FIG. 2, the strapping machine 10 comprises an upright gantry 50, which comprises two upright columns 52 straddling the strapping zone and a cross beam 54 extending transversely over the strapping zone. As shown in FIGS. 2, 3, and 4, a platen 60 is mounted to the upright gantry 50 so as to be vertically movable along the upright columns 52 over a range of vertical movement. Two hydraulic piston-cylinder mechanisms 62 (one shown) are arranged, one along each upright column 52, to raise and lower the platen 60 within such range. Two strapping heads 70 are mounted on the platen 60 in longitudinally spaced relation to each other. As shown in FIGS. 3 and 4, the centerline $C_s$ of the seals applied by the strapping heads 70 is offset to one side from the centerline $C_p$ of the platen 60, which overlies the strapping zone.

The platen 60 is arranged to compress the load 14 supported by the skid 12 as the respective straps 16, 18, are applied by the strapping heads 70. As supplied with a strap 72 of an indeterminate length from a suitable dispenser 74, each strapping head 70 is operable successively and in a known manner to feed the strap 72 around the skid 12 and the supported load 14, to tension the strap 72 so as to form a tensioned loop therearound, to seal the tensioned loop, as by means of a steel seal, and to sever the tensioned loop from the remaining strap. The tensioned loop becomes one of the girth straps 16 or one of the cross straps 18.

Each upright column 52 mounts two strap chutes 80 extending vertically. One of the strap chutes 80 mounted to each upright column 52 is associated with each strapping head 70. As shown in FIG. 3, the platen 60 mounts strap chutes 82 coacting with the strap chutes 80 associated with each strapping head 70 and coacting with an associated one of two strap guides 90 described below to guide a strap being fed by such strapping head 70 around the skid 12 and the supported load 14 and to release the strap when the strap is tensioned by such strapping head 70.

As disclosed in the copending Tipton et al. U.S. patent application Ser. No. 08/123,992 noted above, each strap guide 90 has an elongate channel having a proximal end and a distal end and has means for counteracting tendencies of the distal end of the elongate channel to be downwardly deflected by gravity.

Each strap guide 90 extends transversely from an associated carriage 92, at the proximal end of the elongate channel of such strap guide 90, and is movable with the associated carriage 92 transversely along a supporting beam 94 associated with such strap guide 90. The supporting beams 94 extend transversely from the strapping zone. Each strap guide 90 and the associated carriage 92 are movable transversely along a transverse path defined by the associated beam 94, between an operative position and an inoperative position.

Figure 19:
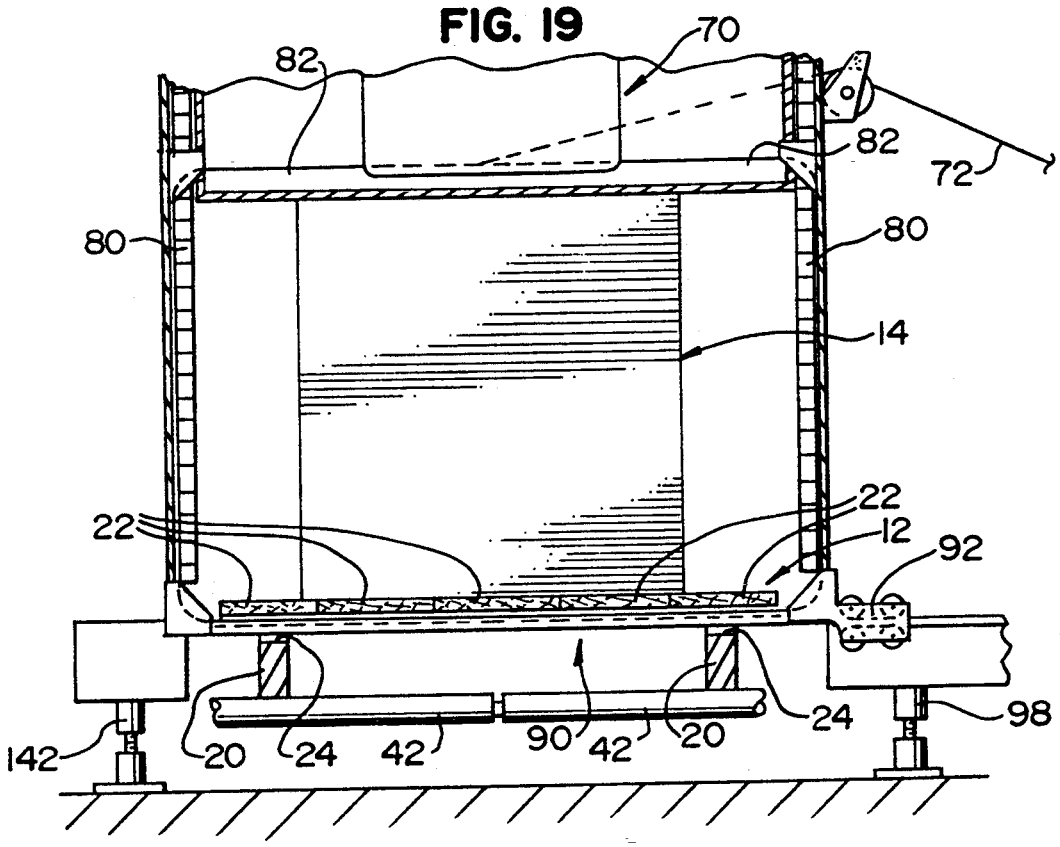
FIG. 19, is an elevational view, looking longitudinally through the strapping zone and showing a strap being applied via a strap chute extending through aligned openings in the skid runners.

In its operative position, such strap guide 90 extends across the strapping zone, through the strap-accommodating openings 24 in the outer runners 20 of the skid 12 if the skid 12 is positioned properly in the strapping zone, so as to complete a strap-guiding path between the strap chutes 80 associated with such strap guide 90. In FIG. 19, one of the strap guides 90 is shown as having been moved to its operative position. In its inoperative position, each strap guide 90 is withdrawn from the strapping zone so as not to interfere with the skid 12 being conveyed into or from the strapping zone.

Each strap guide 90 and the associated carriage 92 are arranged to be conjointly driven along the associated beam 94, between the operative and inoperative positions, by a motor (not shown) via a chain and sprocket drive 96 coacting with the associated carriage 92. Motor-driven jack screws 98 (see FIGS. 2 and 19) are provided for raising and lowering the supporting beams 94, together with the carriages 92 and the strap guides 90, conjointly over a range of vertical movement.

Further details of the strap guides 90 and associated components are found in the Tipton et al. application referenced above. This invention provides the strapping machine 10 with various photoelectric scanners described below.

Near the outlet end of the feeding conveyor 30, the photoelectric scanners of the strapping machine 10 comprise two photoelectric scanners 100 in a horizontal array, in which each scanner 100 comprises a photoelectric transmitter 102 and a photoelectric receiver 104. As shown in FIGS. 2 and 5, the photoelectric transmitter 102 of each such scanner 100 is arranged to transmit a photoelectric beam to the photoelectric receiver 104 of the other scanner 100 unless the photoelectric beam is blocked, as by a skid on the feeding conveyor 30 or by a load supported by the skid. The photoelectric scanners 100 are used to detect when a skid supporting a load and being conveyed by the feeding conveyor 30 is approaching the strapping zone and to activate other photoelectric scanners described below and related controls when the scanners 100 detect the skid 12, the load 14, or both.

The photoelectric scanners of the strapping machine 10 comprise vertical photoelectric scanners 110 including a vertical array of photoelectric transmitters 112, which are disposed in a common housing 114 on one side of the turntable 40, near the inlet end of the turntable 40, and a vertical array of photoelectric receivers 116, which are disposed in a common housing 118 on the other side of the turntable 40. As shown in FIGS. 2 and 5, each photoelectric transmitter 112 is arranged to transmit a photoelectric beam to an associated one of the photoelectric receivers 116 unless the photoelectric beam is blocked, as by the skid 12 on the turntable 40 or by the load 14 supported by the skid 12.

Depending upon whichever of the photoelectric receivers 116 receive such photoelectric beams at successive intervals as the skid 12 and the supported load 14 are conveyed past the vertical arrays of photoelectric transmitters 112 and photoelectric receivers 116, the vertical photoelectric scanners 110 detect the strap-accommodating openings 24 in the outer runners 20 of the skid 12, measure the height of each opening 24, measure the width of each opening 24, and differentiate between such openings 24 and certain types of false openings, as discussed below.

Figure 7:
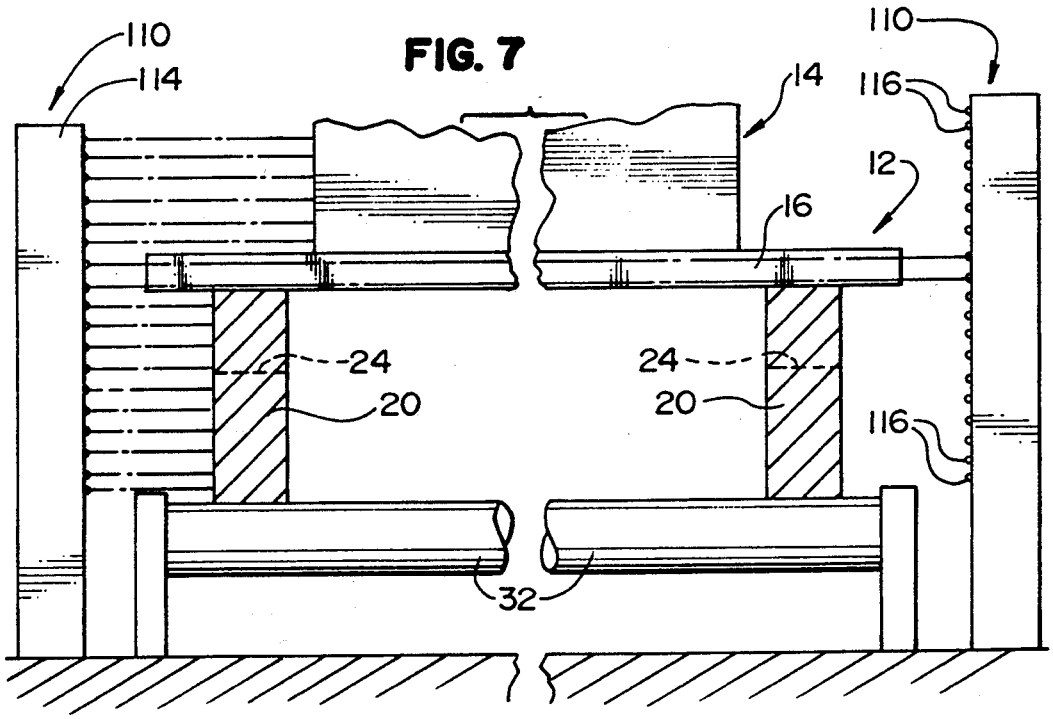
FIG. 7 is a similar, schematic view, looking along the feeding conveyor and showing such a skid and such a supported load as the skid and the load are scanned by the vertical scanning means, when a gap between two decking boards of the skid runners passes the vertical scanning means.

So as to accommodate the strap guides 90 and to allow some clearance, it is preferable that each opening 24 has a minimum height and a minimum width. The vertical photoelectric scanners 110 detect whether each opening 24 has a height not less than a specified, minimum height, e.g. 1.5 inches, and whether each opening 24 has a width not less than a specified, minimum width, e.g. 2.5 inches, but not more than a specified, maximum width, e.g. 4 inches. The minimum width differentiates such an opening 24 from a narrower, false opening, such as a gap between two of the upper decking boards 22 of the skid 12. Such a gap is shown in FIG. 7 as being scanned by the vertical photoelectric scanners 110. The maximum width differentiates such an opening 24 from a wider, false opening, such as the gap between two skid runners of a skid (not shown) having lower decking boards and rotated so that the skid runners extend transversely. Moreover, the vertical photoelectric scanners 110 detect whether the skid 12 supporting the load 14 is rotated so that the outer runners 20 extend obliquely rather than longitudinally or transversely, so as to block all of the photoelectric beams that are transmitted by the photoelectric transmitters 112.

In response to whichever of the photoelectric receivers 116 receive such photoelectric beams from the photoelectric transmitters 112 as the skid 12 and the supported load 14 are conveyed past the vertical arrays of photoelectric transmitters 112 and photoelectric receivers 116, the jack screws 98 are operated so as to raise or lower the supporting beams 94, thereby to position the strap guides 90 at the elevation of the strap-accommodating openings 24. Also, the feeding conveyor 30 and the turntable 40 (in the normal position) are operated so as to position the skid 12 supporting the load 14 in the strapping zone, in a proper position where the strap guides 90 can extend through the strap-accommodating openings 24 in the outer runners 20.

The photoelectric scanners of the strapping machine 10 comprise two sets of horizontal scanners 130, each set being associated with a respective one of the strap guides 90. The horizontal scanners 130 are used to determine whether the skid 12 supporting the load 14 is positioned properly in the strapping zone for the strap guides 90 to extend through the strap-accommodating openings 24 in the outer runners 20.

Each set of horizontal scanners 130 comprises two photoelectric transmitters 132 and two photoelectric receivers 134, namely a photoelectric transmitter 132 on each side of the strapping zone and a photoelectric receiver 134 on each side of the strapping zone. Each photoelectric transmitter 132 is arranged to transmit a photoelectric beam transversely across the strapping zone, toward the photoelectric receiver 134 on the other side of the strapping zone, at an elevation where the photoelectric beam can intersect one of the outer runners 20 of the skid 12 in the strapping zone. Also, each photoelectric receiver 134 is arranged to receive the photoelectric beam transmitted toward it unless such beam is interrupted, as by one of the outer runners 20 of the skid 12 in the strapping zone.

Each photoelectric beam tends to spread as it is transmitted across the strapping zone. However, since, each horizontal scanner 130 employs two photoelectric beams that are transmitted respectively in opposite directions, its photoelectric receivers 134 cannot receive the same beam.

In each set of horizontal scanners 130, the photoelectric transmitter 132 on each side of the strapping zone and the photoelectric receiver 134 on the same side are mounted to the piston rod of a pneumatic piston-cylinder mechanism 136 so as to be conjointly movable between operative positions in the path of transverse movement of the associated strap guide 90 and inoperative positions out of the same path.

On the side where the supporting beams 94 are located, each mechanism 136 is mounted to a respective one of the support beams 94. On the other side of the strapping zone, each mechanism 136 is mounted to a frame 140, which has a motor-driven jack screw 142 for raising and lowering the frame 140 conjointly with the supporting beams 94, which are raised and lowered by means of the jack screws 98. The jack screws 98 and the jack screw 142 are operated conjointly, whereby the mechanisms 136 and the horizontal scanners 130 are raised and lowered conjointly to the same elevations, on both sides of the strapping zone.

Figure 8:
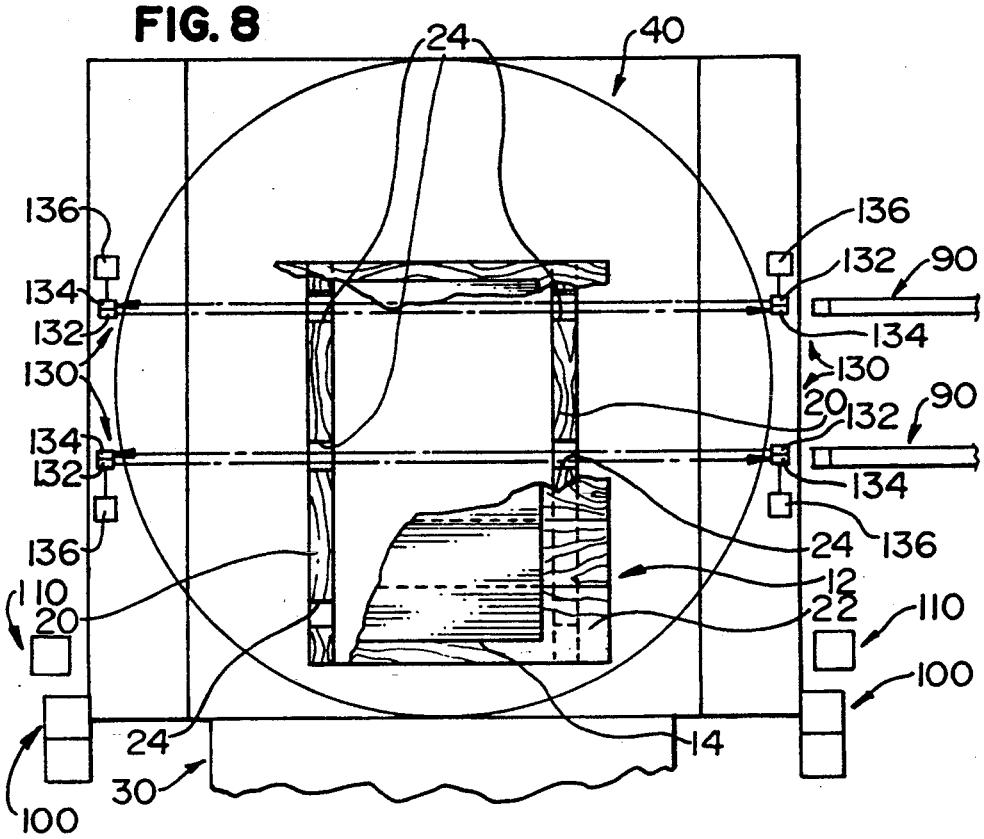
FIGS. 8 and 9 are schematic, plan views, looking downwardly toward such a skid and such a supported load, both being shown fragmentarily, respectively as the skid and the load are scanned by the horizontal scanning means in operative positions and as the strap guides are advanced with the horizontal scanning means in inoperative positions.
Figure 9:
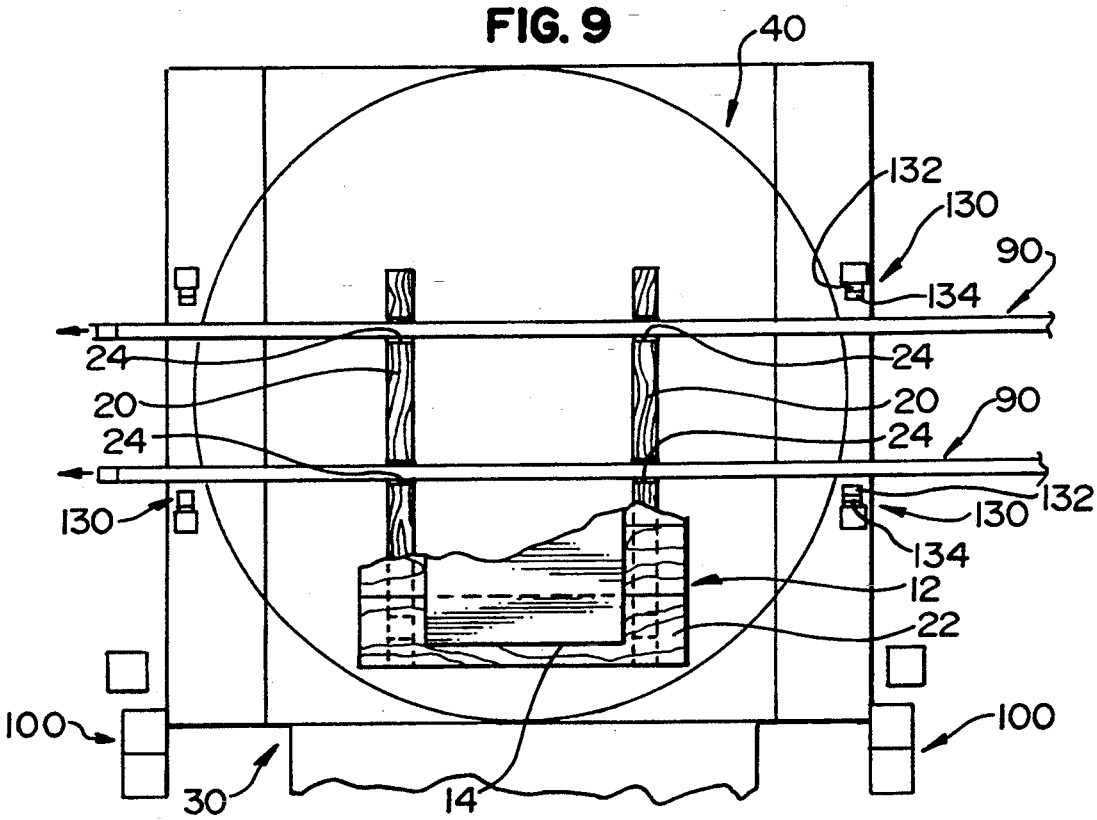

As shown in FIG. 8, if both horizontal scanners 130 are operated and if the skid 12 supporting the load 14 is positioned properly within the strapping zone in what may be conveniently described as an initial girth-strapping position, in which both strap guides 90 can extend freely through respective first and second pairs of the strap-accommodating openings 24 in the outer runners 20, all of the photoelectric receivers 134 receive the photoelectric beams transmitted by the corresponding transmitters 132. Thereupon, as shown in FIG. 9, the respective mechanisms 136 are operated to move the photoelectric transmitters 132 of both horizontal scanners 130 and the photoelectric receivers 134 thereof to their inoperative positions, whereupon both strap guides 90 are moved to their operative positions, in which two girth straps 16 are applied via the strap guides 90.

Figure 10:
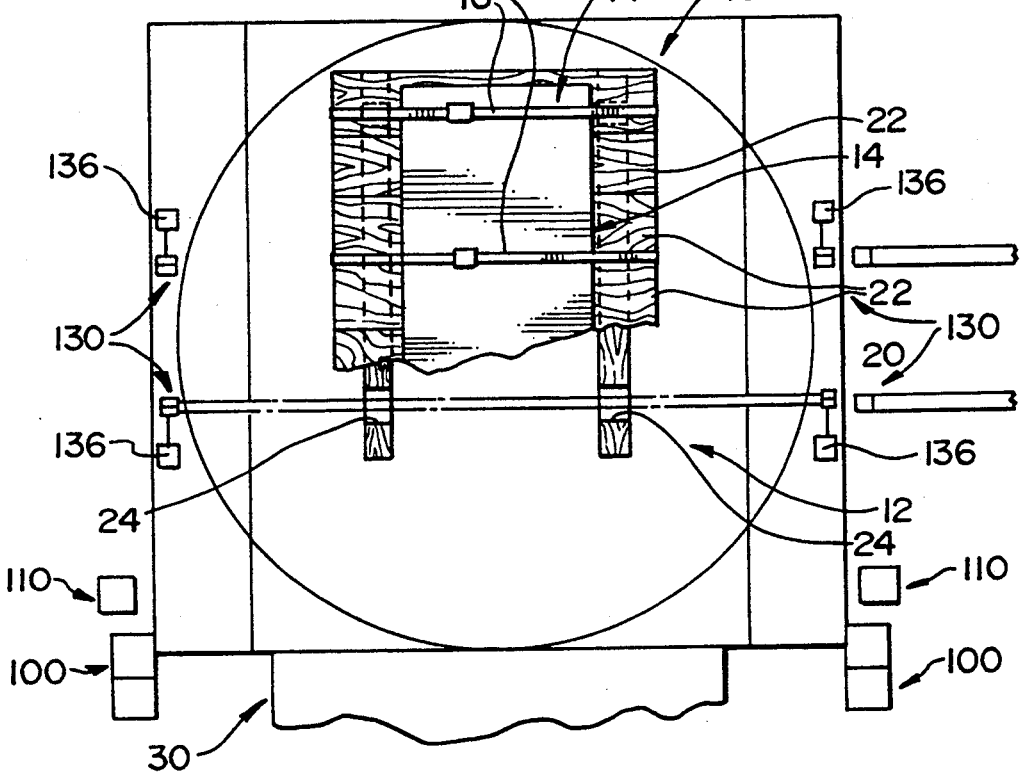
FIGS. 10 and 11 are similar, schematic views, showing the skid and the supported load as having been conveyed forwardly to a proper position for strapping with another girth strap, respectively as the skid is scanned by one selected set of horizontal scanning means in operative positions and as one of the strap guides is advanced with the selected set of horizontal scanning means in inoperative positions and as the strap guides are advanced with the selected set of horizontal scanning means in inoperative positions.
Figure 11:
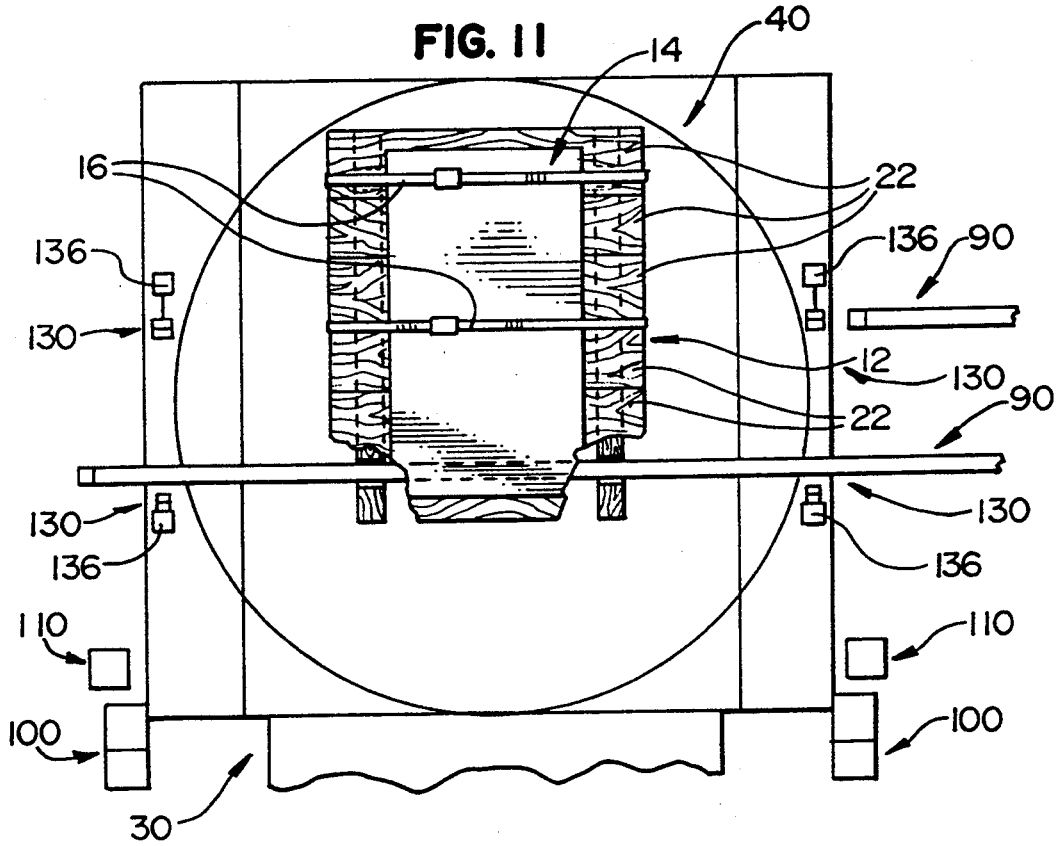

As shown in FIG. 10, after the first and second girth straps 16 have been applied in the manner described above, the turntable 30 is operated so as to move the skid 12 and the supported load 14 within the strapping zone to what may be conveniently described as a further girth-strapping position, in which a selected one of the strap guides 90 can extend freely through a third pair of the strap-accommodating openings 24 in the outer runners 20. Thus, the associated, photoelectric receivers 134 receive the photoelectric beams transmitted by the associated, photoelectric transmitters 132. Thereupon, as shown in FIG. 9, the associated mechanisms 136 are operated to move the associated, photoelectric transmitters 132 and the associated, photoelectric receivers 134 to their inoperative positions, whereupon the selected guide 90 is moved to its operative position, in which a third girth strap 16 is applied via the selected guide 90.

Figure 18:
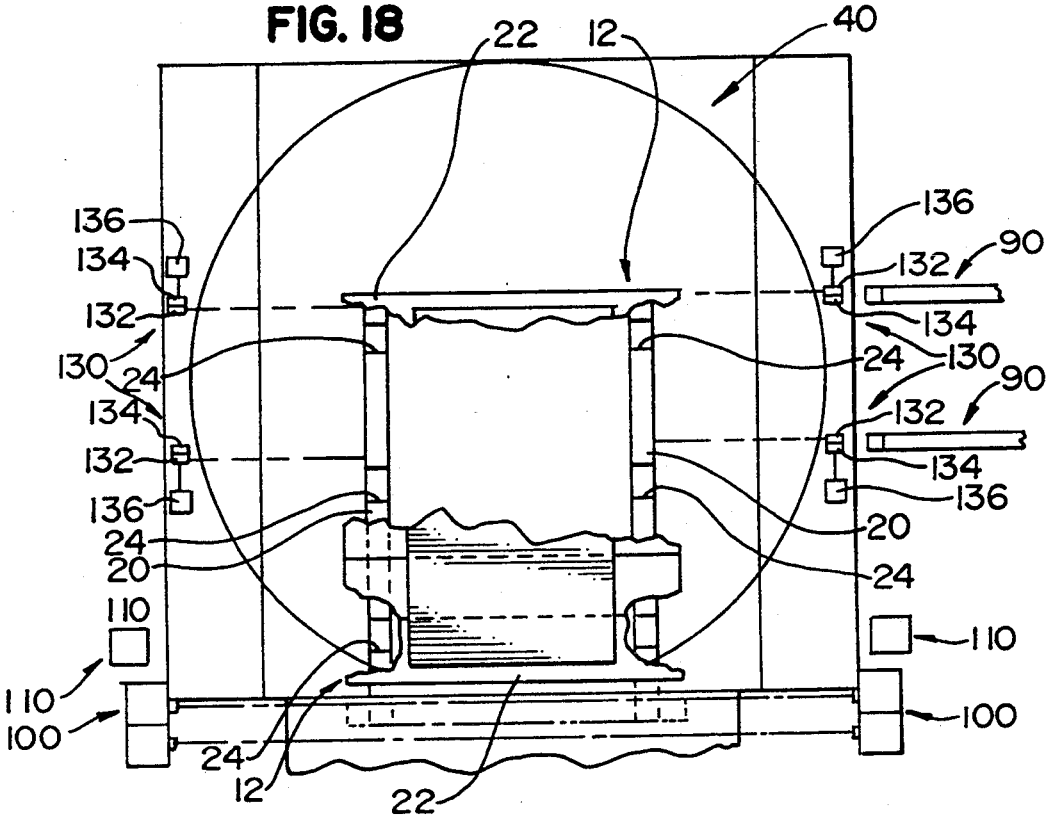
FIG. 18, on the scale of FIGS. 10 through 13, is a similar, schematic view, showing the skid and the supported load not in a proper position for the strapping machine to apply a girth strap.

As shown in FIG. 18, if both horizontal scanners 130 are disposed in their operative positions and are operated but if the skid 12 supporting the load 14 is not positioned properly in the strapping zone for both strap guides 90 to extend freely through two respective pairs of the strap-accommodating openings 24 in the outer runners 20, all of the photoelectric receivers 134 do not receive the photoelectric beams transmitted by the corresponding transmitters 132. The strapping machine 10 is arranged so that, if both horizontal scanners 130 are operated and if any photoelectric receiver 134 does not receive the photoelectric beam from the corresponding transmitter 132, the operation of the strapping machine 10 is aborted until corrective action is taken.

As shown in FIG. 12, after all girth straps 16 have been applied, the turntable 40 is operated to rotate the skid 12 and the supported load 14 by one quarter-turn whereupon both horizontal scanners 130 are operated to determine whether the skid 12 is positioned properly for the strap guides 90 to pass freely between the outer runners 20 of the skid 12 without interfering with any other part of the skid 12. Thereupon, as shown in FIG. 13, the respective mechanisms 136 are operated to move the photoelectric transmitters 132 of both horizontal scanners 130 and the photoelectric receiver 134 thereof to their inoperative positions, whereupon both strap guides 90 are moved to their operative positions, in which two cross straps 18 are applied via the strap guides 90.

Figure 14:
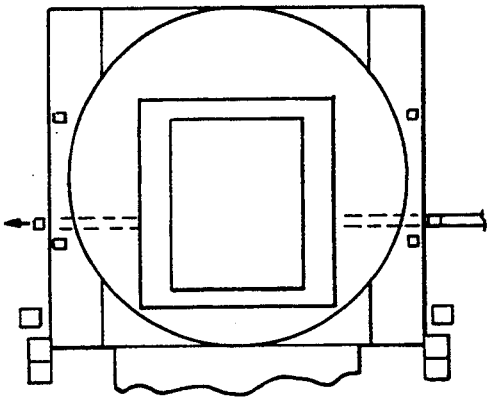
FIGS. 14 through 17, on a smaller scale, are similar, schematic views, showing the skid and the supported load respectively as one girth strap is applied, as two girth straps are applied, as another girth strap is applied after two girth straps have been applied, and as two cross straps are applied.
Figure 15:
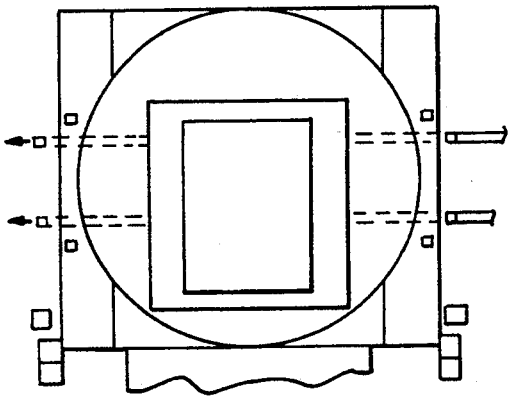
Figure 16:
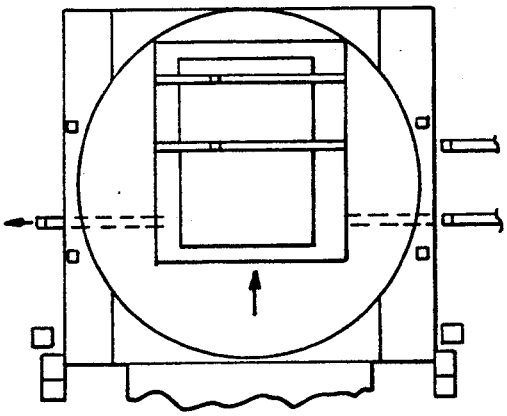
Figure 17:
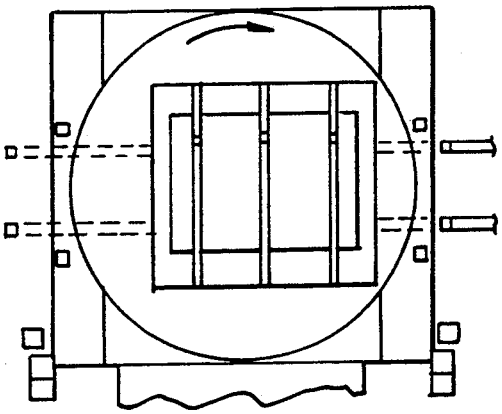

As shown schematically in FIG. 14, the strapping machine 10 is operable to apply a single girth strap 16. As shown schematically in FIGS. 15 and 16, the strapping machine 10 is operable to apply three girth straps 16, the first and second girth straps being applied initially and the third girth strap being applied subsequently. In further reference to FIGS. 15 and 16, either the middle girth strap 16 or the third girth strap 16 may be optionally omitted. As shown schematically in FIG. 17, the strapping machine 10 is operable to apply one or two cross straps 18, which may be optionally omitted.

As shown in FIG. 5, the strapping machine 10 comprises a programmable controller 200 that is programmed to control the various motors and piston-cylinder mechanisms of the strapping machine 10 in response to the various photoelectric scanners described above, so as to provide the various functions described above. Programming of the programmable controller 200 to achieve the various strapping patterns is within the level of skill of a person having ordinary skill in the art.

Various modifications may be made in the preferred embodiment described above without departing from the scope and spirit of this invention.

We claim:

1. A strapping machine for strapping a skid having parallel runners including two outer runners and having aligned openings in the respective runners, together with a load supported by the skid, the strapping machine being operable with a conveyor for conveying the skid and the supported load longitudinally through a feeding zone defined by the conveyor, (a) means including a turntable with powered rollers for receiving the skid and the supported load from the conveyor, for positioning the skid and the supported load in a girth-strapping position within a strapping zone defined by the turntable, by means of the powered rollers of the turntable, and for rotating the skid and the supported load to a cross-strapping position within the strapping zone, by means of the turntable, (b) means including a strap guide for guiding a strap through aligned openings in the respective runners, when the skid and the supported load are positioned in the girth-strapping position, the strap guide extending transversely and being movable along a path of transverse movement between an extended position, in which the strap guide extends across-the strapping zone, and a withdrawn position, in which the strap guide is withdrawn so as not to interfere with the skid or the supported load, the strap guide having a channel with a distal end and including means for counteracting tendencies of the distal end to be downwardly deflected by gravity, so as to adapt the strap guide to extend through aligned openings in the respective runners when the skid and the supported load are positioned in the girth-strapping position and to extend between the outer runners when the skid and the supported load are positioned in the cross-strapping position, and (c) means including a strapping head for passing a strap through the strap guide in the extended position, so as to pass the strap through aligned openings in the respective runners when the skid and the supported load are positioned in the girth-strapping position within the strapping zone and so as to pass the strap between the outer runners when the skid and the supported load are positioned in the cross-strapping position, the strapping head being operable to apply the strap around the supported load.

2. The strapping machine of claim 1 further comprising means for scanning the skid and the supported load as the skid and the supported load are conveyed through the feeding zone, and wherein the conveying means and the positioning and rotating means are operable in response to the scanning means for positioning the skid and the supported load in the girth-strapping position.

3. The strapping machine of claim 2 wherein the scanning means include vertical scanning means, which include means for transmitting a vertical array of parallel photoelectric beams transversely across the feeding zone, at elevations where at least some of the photoelectric beams of the vertical array can intersect one of the outer runners of the skid when the skid is conveyed through the feeding zone, and which further include means for receiving whichever of the photoelectric beams of the vertical array are not interrupted, as by one of the outer runners of the skid when the skid is conveyed through the feeding zone.

4. The strapping machine of claim 3 wherein the transmitting means of the vertical scanning means include a vertical array of photoelectric transmitters spaced from one another, on one side of the feeding zone, and wherein the receiving means of the vertical scanning means include a vertical array of photoelectric receivers spaced from one another, on the other side of the feeding zone.

5. The strapping machine of claim 4 wherein the scanning means further include horizontal scanning means, which include means for transmitting a horizontal array of parallel photoelectric beams transversely across the strapping zone, at an elevation where the photoelectric beams of the horizontal array can intersect one of the outer runners of the skid in the strapping zone, and which further include means for receiving whichever of the photoelectric beams of the horizontal array are not interrupted, as by one of the outer runners of the skid in the strapping zone.

6. The strapping machine of claim 5 wherein the transmitting means of the horizontal scanning means include a photoelectric transmitter on each side of the strapping zone, wherein the receiving means of the horizontal scanning means include a photoelectric receiver on each side of the strapping zone, and wherein each photoelectric transmitter is arranged to transmit a photoelectric beam toward the photoelectric receiver on the other side of the strapping zone.

7. The strapping machine of claim 6 wherein the transmitting and receiving means of the horizontal scanning means are movable between operative positions in the path of transverse movement of the strap guide and inoperative positions out of the path of transverse movement of the strap guide.

8. The strapping machine of claim 7 further comprising means, which are operative in response to whichever of the photoelectric receivers of the vertical scanning means receive such photoelectric beams from the photoelectric transmitters of the vertical scanning means as the skid and the supported load are conveyed past the vertical arrays of photoelectric transmitters and photoelectric receivers, for positioning the horizontal scanning means vertically.

9. The strapping machine of claim 4 wherein the strap guide is one of two strap guides, each strap guide extending transversely and being movable between such an extending position and such a withdrawn position, and wherein the strapping head is one of two strapping heads, each strapping head being operable similarly in coaction with one of the strap guides, the strapping machine being operable selectively to apply no strap, one strap, or two straps when the skid and the supported load are in either of the girth-strapping and cross-strapping positions.

10. The strapping machine of claim 9 wherein the scanning means further include two horizontal scanning means, wherein the transmitting means of each horizontal scanning means include two photoelectric transmitters, one on each side of the strapping zone, wherein the receiving means of each horizontal scanning means include two photoelectric receivers, one on each side of the strapping zone, and wherein each photoelectric transmitter of each horizontal scanning means is arranged to transmit one of the photoelectric beams toward the photoelectric receiver of said horizontal scanning means on the other side of the strapping zone.

11. The strapping machine of claim 9 wherein the transmitting and receiving means of the horizontal scanning means are movable between operative positions in the paths of transverse movement of the strap guides and inoperative positions out of the paths of transverse movement of the strap guides.

12. The strapping machine of claim 9 further comprising means, which are operative in response to whichever of the photoelectric receivers of the vertical scanning means receive such photoelectric beams from the photoelectric transmitters of the vertical scanning means as the skid and the supported load are conveyed past the vertical arrays of photoelectric transmitters and photoelectric receivers, for positioning the horizontal scanning means vertically.

13. The strapping machine of claim 1 wherein the strap guide is one of two strap guides, each strap guide extending transversely and being movable along a path of transverse movement between such an extending position and such a withdrawn position, and wherein the strapping head is one of two strapping heads, each strapping head being operable similarly so as to coact with a respective one of the strap guides, the strapping heads being operable selectively to apply no strap, one strap, or two straps when the skid and the supported load are in either of the girth-strapping and cross-strapping positions.

14. The strapping machine of claim 13 wherein the strapping heads are mounted on a platen extending between two upright columns and being movable vertically along the upright columns.

15. The strapping head of claim 14 wherein the strapping heads are interchangeable with other strapping heads so as to enable the strapping machine to be selectively useful with steel strapping or with polymeric strapping.

16. The strapping machine of claim 13 further comprising means for scanning the skid and the supported load as the skid and the supported load are conveyed through the feeding zone, and wherein the conveying means and the positioning and rotating means are operable in response to the scanning means for positioning the skid and the supported load in the girth-strapping position.

* * * * *